US008545790B2

(12) United States Patent
Konesky

(10) Patent No.: US 8,545,790 B2
(45) Date of Patent: Oct. 1, 2013

(54) CROSS-LINKED CARBON NANOTUBES

(76) Inventor: Gregory Konesky, Hampton Bays, NY (US)

( * ) Notice: Subject to any disclaimer, the term of this patent is extended or adjusted under 35 U.S.C. 154(b) by 386 days.

(21) Appl. No.: 11/144,954

(22) Filed: Jun. 4, 2005

(65) Prior Publication Data

US 2006/0275956 A1 Dec. 7, 2006

(51) Int. Cl.
*D01F 9/12* (2006.01)
*H01L 21/82* (2006.01)

(52) U.S. Cl.
USPC ..... 423/447.1; 423/447.2; 438/128

(58) Field of Classification Search
USPC ..... 423/447.2; 977/742, 745, 847, 740; 438/128
See application file for complete search history.

(56) References Cited

U.S. PATENT DOCUMENTS

| | | | | |
|---|---|---|---|---|
| 6,872,645 | B2 * | 3/2005 | Duan et al. | 438/584 |
| 2005/0037204 | A1 * | 2/2005 | Osiander et al. | 428/408 |
| 2006/0054488 | A1 * | 3/2006 | Harmon et al. | 204/157.15 |
| 2007/0084797 | A1 * | 4/2007 | Cooper et al. | 210/660 |

OTHER PUBLICATIONS

Correa-Duarte et al., "Fabrication and Biocompatibility of Carbon Nanotube-Based 3D Networks as Scaffolds for Cell Seeding and Growth," 2004, Nano Letters, vol. 4, No. 11, pp. 2233-2236.*
Cheng et al., "Hydrogen storage in carbon nanotubes," 2001, Carbon, 39, pp. 1447-1454.*
Chattopadhyay et al., "Metal-Assisted Organization of Shortened Carbon Nanotubes in Monolayer and Multilayer Forest Assemblies," 2001, J. Am. Chem. Soc., 123, pp. 9451-9452.*
Mamedov et al., "Molecular design of strong single-wall carbon nanotube/polyelectrolyte multilayer composites," 2002, Nature Materials, vol. 1, pp. 190-194.*

* cited by examiner

*Primary Examiner* — Bijay Saha
(74) *Attorney, Agent, or Firm* — Gerald E. Hespos; Michael J. Porco; Matthew T. Hespos

(57) ABSTRACT

Cross-linked carbon nanotube arrays forming a three-dimensional structure and methods of use including high thermal conductivity, high strength applications where repeated cycling is known, and chemical storage.

13 Claims, 3 Drawing Sheets

Figure 1

Comparison of Thermal Conductivities for Various Materials

| Material | Thermal Conductivity (W/m-K) |
|---|---|
| Copper | 390 |
| Silver | 430 |
| Diamond | 2600 |
| Carbon Nanotubes | 6600 |

Figure 2

Comparison of Stiffness, Strength and Density for Various Materials

| Material | Young's Modulus (GPa) | Tensile Strength (GPa) | Density ($g/cm^3$) |
|---|---|---|---|
| Single Wall Carbon Nanotubes | 1054 | 150 | 1.4 |
| Multi-Wall Carbon Nanotubes | 1200 | 150 | 1.6 |
| Steel | 208 | 0.4 | 7.8 |
| Epoxy | 3.5 | 0.005 | 1.25 |
| Wood | 16 | 0.008 | 0.6 |

CROSS-LINKED CARBON NANOTUBES

FIELD OF THE INVENTION

This disclosure relates to the cross-linked carbon nanotubes for use in thermoconductivity and hydrogen storage, and methods of manufacturing the carbon nanotubes.

RELATED APPLICATION

This application is related to Disclosure Documents 565596 (Nov. 14, 2004; 565597 (Nov. 22, 2004); and 542604 (Nov. 28, 2003).

BACKGROUND

Carbon nanotubes, like fullerenes, are comprised of shells of carbon atoms forming a network of hexagonal structures, which arrange themselves helically into a three-dimensional cylindrical shape. The helix arrangement, or helicity, is the arrangement of the carbon hexagonal rings with respect to a defined axis of a tube. Generally, the diameter of a nanotube may range from approximately 1 nanometer ("nm") to more than 100 nm. The length of a nanotube may potentially be millions of times greater than its diameter. Carbon nanotubes are chemically inert, thermally stable, highly strong, lightweight, flexible and electrically conductive, and may have greater strength than any other known material.

Common methods for the manufacturing of nanotubes include high-pressure carbon monoxide processes, pulsed laser vaporization processes and arc discharge processes. These processes produce nanotubes by depositing free carbon atoms onto a surface at high temperature and/or pressure in the presence of metal catalyst particles. The nanotubes typically form as bundles of tubes embedded in a matrix of contaminating material composed of amorphous carbon, metal catalyst particles, organic impurities and various fullerenes depending on the type of process used. Bundles of nanotubes formed by these manufacturing methods can be usually extremely difficult to separate.

Current methods for purifying and isolating nanotubes to remove contaminating matrix surrounding the tubes employ a variety of physical and chemical treatments. The treatments include high temperature acid reflux of raw material in an attempt to chemically degrade contaminating metal catalyst particles and amorphous carbon, the use of magnetic separation techniques to remove metal particles, the use of differential centrifugation for separating the nanotubes from the contaminating material, the use of physical sizing meshes (i.e., size exclusion columns) to remove contaminating material and physical disruption of the raw material utilizing sonication. Additionally, techniques have been developed to partially disperse nanotubes in organic solvents in an attempt to purify and isolate the structures. The uniformity of a matrix may also be improved by lowering the amount of nanotubes, however the overall composite strength is proportionally reduced.

The use of carbon nanotubes has been proposed for numerous commercial applications, such as, for example, catalyst supports in heterogeneous catalysis, high strength engineering fibers, sensory devices and molecular wires for electronics devices. Accordingly, there has been an increasing demand for carbon nanotube structures that are free of impurities which often occur due to defects and variations in production, or growth rate. Additionally, although individual Carbon nanotubes have demonstrated useful properties when used as a filler in composite materials, those aggregate properties fall short of what would be expected. This is due in part to the presence of defects and variations, the tendency to bundle which prevents full or uniform dispersal in a composite, and the common interference/attractive effects between individual isolated nanotubes.

It would be advantageous to provide a carbon nanotube which overcomes the above shortcomings. An improved carbon nanotubes would provide multiple pathways around defects and allow a continuous path for mechanical and thermal forces.

SUMMARY

This disclosure relates to an array of carbon nanotubes monolayers that are substantially free of other materials which are constructed to form a three-dimensional array of multiple nanotube monolayers of functionalized, cross-linked nanotubes.

A method of manufacturing carbon nanotube arrays is also disclosed wherein the carbon nanotube arrays are substantially free of non-carbon materials and are formed by functionalizing nanotubes, forming nanotube monolayers, polymerizing the nanotube monolayers, forming a cross-linked film of nanotube monolayers, layering multiple cross-linked films of nanotube monolayers, functionalizing the layers of cross-linked films of nanotube monolayers, inter-linking the functionalized cross-linked films of nanotube monolayers, to form a three-dimensional carbon nanotube array for various applications.

A method of conducting thermal discharge in electronic and mechanical devices is disclosed involving forming a three-dimensional carbon nanotube array of functionalized, cross-linked nanotubes essentially free of non-carbon materials.

DRAWINGS

FIG. 1 is a chart comparing the thermal conductivities of various commonly used materials.

FIG. 2 is a chart comparing the stiffness, strength and density for various commonly used materials.

DETAILED DESCRIPTION

Figure 3:
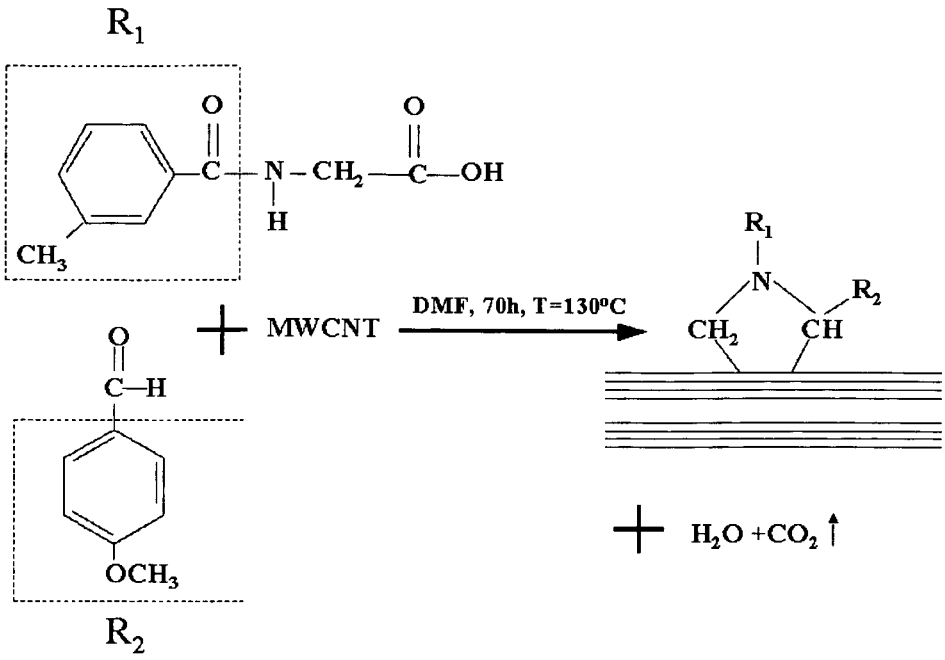
FIG. 3 illustrates an organic functionalization reaction which produces functional groups on nanotube surfaces.

The present disclosure relates to a cross-linked carbon nanotube array which are not imbedded in a matrix or composite material for use in a variety of applications. The cross-linked nanotube array is substantially, essentially free of other, non-carbon materials. Individual nanotubes may be formed as single wall or multiple wall structures, and certain structures may be employed according to an intended use. Carbon nanotubes demonstrate exceptional strength and thermal conductivity, and are therefore ideal for heat sink and/or heat dispersal applications. A three-dimensional structure of the cross-linked nanotubes can also be employed as a highly efficient and economical hydrogen storage system.

The cross-linked carbon nanotubes ("CNTs") can overcome or minimize limiting problems often associated with conventional nanotubes, such as defects, variations in production, wetting characteristics or tangled nanotubes in a mass. The cross-linked nanotubes provide multiple pathways to circumvent defects, and allow continuous pathways for mechanical and thermal forces. The pathway improvements may be further enhanced by rotation of the orientation of cross-linked CNTs layers. The layers are formed of aligned CNTs, and alternated according to alignment. The alternating effect is analogous to alternating wood grain orientation in successive layers of plywood, which provides its great strength.

Potential conventional methods for cross-linking carbon nanotubes may include a number of methods to form a three dimensional array of nanotubes. One possible method is heating of the nanotube array in a vacuum to high temperatures, after which the array is subjected to electron beam bombardment. This heating approach is a relatively simple procedure, however it allows little control of the resulting structure. Similarly, damage/annealed cross-linking process may be used. Under this process, an initial monolayer of parallel-aligned carbon nanotubes is placed is typically heated to at least 800 degrees C.° on a heating stage and within a vacuum. The monolayer is then subjected to electron beam bombardment, which produces regions of localized damage to the nanotubes while the heating affects an annealing process. This heating process anneals or "heals" the damage, and links adjacent nanotubes to each other. While this process is relatively straight forward, the location and degree of damage and the annealing process can be controlled only in a general fashion. The variables of the heating temperature and duration, electron beam energy and current density can be optimized to an extent to customize the cross-linking. Alternating cycles of electron beam damage and thermal annealing can permit greater control on the nature of the cross-linking, however the overall processing time is also increased. Other alternative methods include hydrogen bonding, or any conventional method, to cross-linking the nanotubes.

A highly efficient method of cross-linking is condensation polymerization of functionalized nanotubes where the functional groups may be formed on the exterior of the nanotubes. The nanotubes may be functionalized by any convenient method. The functionalized nanotubes are more soluble in organic solvent to allow the nanotubes to be separated in to individual tubes, although alignment is random at this stage. Typically, the organic solvent used as a solvent can be mildly polar.

Functionalized carbon nanotubes are soluble in mildly polar organic solvents. This solubility permits the production of a monolayer or very thin film of aligned nanotubes, using the Langmuir-Blodgett technique, which is commonly used to transfer a self-assembled monolayer of molecules from the liquid phase to the surface of a substrate. The Langmuir-Blodgett Technique generally consists of vertically drawing a substrate through the monolayer/water interface to transfer the monolayer onto the substrate, and this technique also involves controlling and adjusting variables including the temperature, surface pressure, and rate of drawing the substrate. Details of the Langmuir-Blodgett Technique are described Petty, M. C., *Langmuir-Blodgett Films an Introduction*, Chaps. 3 and 4, Cambridge Univ. Press, NY. (1996).

Flow alignment is an alternate technique which may be used in this process, such as, for example, the techniques disclosed in U.S. Pat. No. 6,872,645 and US Patent Application 2005/0067349, incorporated herein by reference in their entirety.

Condensation polymerization produces high-strength cross-linked nanotubes by permitting control of the location, spacing and length of the cross-links. These parameters can optimized and customized for an intended use and provide flexibility to control the nature of the cross-linking. Condensation polymerization cross-linking employs the same functional groups that provide solubility for the carbon nanotubes. The nanotubes cross-link to adjacent aligned nanotubes to form a monomer. The nanotubes may be aligned, where desired, by any convenient method, including those methods disclosed in U.S. Pat. Nos. 6,887,450, 6,872,645, 6,866,801 and 6,790,425, incorporated herein by reference in their entirety. The resulting monomer is a two-dimensional network which has great tensile strength both in the direction of alignment and the direction of the interlinking.

A commonly used cross-linking condensation polymerization functionally attaches a hydroxyl group a first nanotube. Upon exposure to a catalyst, the hydroxyl group and a hydrogen atom on an adjacent nanotube combine to produce a water molecule, and cross-linking occurs between the adjacent sites that molecules had previously occupied. The catalyst-driven reaction occurs repeatedly between adjacent functionalized nanotubes to provide a plurality of cross-links between nanotubes.

By increasing the number of functional groups attached to a nanotube, the number of potential cross-links between adjacent nanotubes is also increased. The number of functional groups attached to a nanotube is controlled by process conditions during the functionalization procedure, such as temperature, duration and/or pH. The length of the cross-link depends on the specific functional group employed. Minimal length cross-links, which may ideally be only one carbon atom long, are typically employed to maximize overall storage density.

Once a monolayer is produced, its electrical properties may be characterized to determine the quality of monolayer films in an early stage. In order to characterize the electronic properties of the films, electrical conductivity is determined and should be characterized over a wide range of temperatures. Measurement of the magneto resistance may also be taken to determine surface scattering effects on electron transport. Measurement of the thermoelectric properties provides information on the electronic density-of-states and scattering mechanisms near the Fermi surface. Ballistic Electron Emission Microscopy ("BEEM") may also be used to measure localized electronic properties of nanostructures. BEEM is a low energy electron microscopy technique for lateral imaging and spectroscopy (with nm resolution for buried structures placed up to 30 nm below the surface).

A second functionalization process may then inter-link neighboring functional groups located on nanotubes of individual monolayers that are above and below the monolayer plane. Three-dimensional structures are formed of multiple monolayer films in subsequent condensation polymerization reactions, which results in a stacking effect. An alternative process to form three-dimensional structures would include electron beam welding, such as, for example, the methods disclosed in U.S. Pat. Nos. 4,673,794; 4,271,348; and 4,229,639 which are incorporated herein in their entirety.

The stacking of the monolayers may proceed in either a random orientation sequence or co-aligned with the preceding monolayer where the stacking is unconstrained. The aligned, orderly nanotubes of the co-aligned configuration provide greater strength in the alignment direction where the physical/mechanical strength of the nanotubes runs along their lengths, and the alignment provides more opportunities for cross-linking between the nanotubes, as compared to random orientation. Macroscopically thick sheets may then be joined at right angles, i.e. joining to sheets or films above and below, to improve the strength in all directions.

Alternatively, individual monolayers may be rotated approximately 90 degrees prior to the condensation polymerization step to provide omni-directional strength. The nanotubes of each monolayer in a stack are aligned at right angles to the nanotubes of the monolayer immediately above and below it. A conventional binary grouping procedure can be employed to add additional nanotubes layers to lower the number of procedural steps. Alternatively, multiple polymerizations procedures may be used to add nanotubes layers, however approximately $10^5$ rotate and polymerize operations would be required to build up approximately a millimeter thickness. For example, two monolayers may be linked or joined at right angles to form a grouping, and a second grouping, which has been previously linked, may then be linked to a first grouping at right angles, to produce a four-layer stack, and so on. Several monolayers may be placed on top of one another while rotating the alignment axis approximately 90 degrees with each successive layer.

The stacked alternating monolayers may then be subjected to a cross-linking process, or inter-linking, of the multiple monolayers to join the nanotubes of individual monolayers at various points of contact. The inter-linking may be done by a second functionalization procedure. Alternatively, the inter-linking process can be an ion bombardment process, using argon ions, to displace several carbon atoms at a point of contact between nanotubes. The ion bombardment process requires an optimum energy range. No cross-linking is observed below a minimum energy level, and above a maximum energy level, more carbon atoms are removed than are displaced into cross-linking, which results in a net erosion of the nanotubes. The movement and arrangement of the displaced carbon atoms produces linking bonds between the nanotubes which retain and reinforce the alternating layer pattern. The carbon-carbon bonds that are formed are at least as strong as the nanotubes themselves. The combinations of ion energy and ion flux (the number of ions flowing through a given area) are balanced to optimize these parameters.

Cross-linking adjacent nanotubes results in a physically robust structure. Large-scale inter-linking of monolayers of nanotubes, and the adjacent nanotubes within those layers, minimizes the impact of defects of any given nanotube by providing alternative pathways. The three-dimensional structures of the cross-linked nanotubes also produce a myriad of appropriate, interstitial spaces for use as efficient hydrogen adsorption and storage on the surface of the nanotubes, as well as storage of other chemicals, in a safe, low cost means. An aligned array of nanotubes provides more interstitial spaces and surface area on individual nanotubes for hydrogen storage uses. Such physically adsorbed hydrogen molecules are easily attached and removed to the nanotube surface, which readily facilitates the application to bulk hydrogen storage. The availability of additional interstitial sites between nanotubes increase hydrogen adsorption increase dramatically. Additionally, the open network structure of three-dimensional cross-linked nanotube arrays allows easy access to the bulk interior to provide high conductance pathways for hydrogen. These conductance pathways allow the hydrogen to readily shift into, and out of, the bulk material of the nanotube array for rapid charge and discharge cycles. The mechanically robust structure of cross-linked nanotube array prevents or inhibits physical degradation during repeated cycling (which is a common problem with other hydrogen storage media and ultimately leads to loss of storage capacity). The nanotube array also exhibits the mechanical strength to withstand the mechanical shocks and vibrations characteristic of typical application environments.

The mechanical robustness of the carbon nanotube array is due in part to the extremely high strength-to-weight ratios of carbon nanotubes, as compared to other materials. As shown in FIGS. 1 and 2, the observed strength of carbon nanotubes is well above that of any other material, which provides the mechanical strength to withstand the rigorous environments of many applications. The discrepancy found between the calculated value of carbon nanotubes strength and the experimental values is due to defects or variations that are introduced during the synthesis process.

The highly electrically conductive nature of the cross-linked array may be used as a means of monitoring the structural integrity during testing, and as a quality assurance tool during production. These electrical characteristics can also function as a native or built-in resistive heater for the desorption of previously adsorbed hydrogen on the nanotubes.

The thermal conductivity in aligned, cross-linked nanotube arrays is provided by a plurality of pathways to conduct and disperse heat. These arrays are isotropic due to the multitude of alternate phonon paths that run from thermal sources to thermal sinks. Any defect that might exist in the three-dimensional array would cause only minimal scattering of phonons since a plurality of alternate paths are provided by the cross-linking around any defect. Therefore, these nanotube arrays can be highly useful in high-end heat spreading applications and as efficient as chemical vapour deposition (CVD) diamonds that are produced as heat spreaders.

The measurement of thermal conductivity in nanotubes arrays may be preformed on a thin film characterization. A typical thin film thermal conductivity characterization can be done on a substrate with relatively low thermal conductivity. One thermal conductivity measurement method is via vapor-deposited films, where the films are approximately half-micron thick and deposited onto substrates or membranes. Characterization methods such as, for example, those disclosed in U.S. Pat. Nos. 6,668,230; 6,553,318; 6,535,824; 6,535,822; and 6,477,479 may be employed, which are incorporated by reference herein in their entirety. As in heat capacity measurements, thermal conductivity measurements preferably minimize the effects of the substrate's thermal characteristics on the overall measurement results. A sensor structure for thermal conductivity measurements can be formed of, for example, a silicon-nitride membrane. A silicon-nitride membrane, or similar material, includes thermal characteristics which may be easily detected and separated from the thermal characteristics of a sample to be tested. A thermal gradient may be created by placing a heater on one end of the substrate. Thermocouples are placed at various points along the substrate, and the rate of rise along the thin film deposited on this substrate may then be measured. Such measurements, however, are necessarily one-dimensional. Other methods include evaporation from a solution or suspension to deposit thin film samples.

It will be appreciated that the exceptionally high thermal conductivity of nanotubes allows very thin films to function well, and therefore far less material is necessary as compared to composite or matrix materials. The nanotube array provides an economic advantage, which easily offsets any disparity in initial material costs. Multi-wall nanotubes are much less expensive than single wall nanotubes and are suitable for this application, further enhancing a mass production economics. For use in heat spreader applications, the nanotubes may be formed in a mass or tangle to eliminate the alignment process. A mass of nanotubes may conduct heat relatively equally in many directions. Additionally, nanotubes are relatively chemically inert and are therefore readily compatible with semiconductor processes, and other electronic applications.

An excellent example of an application and use of the cross-linked carbon nanotubes array is as a heat spreader in electronic equipment. As electronic equipment and devices become faster and ever more small and compact, one important parameter of the equipment has largely been overlooked. That parameter is the ability to remove waste heat from a computer's central processing unit (CPU) as necessary. As computers and computer run equipment advance, they will generate increasing more waste heat as a result of increasing clock speeds. As they advance, computers will also contain increasing smaller component sizes, which will cause waste heat to be dissipated into a higher density footprint. The increased heat discharge must flow into a heat sink, however the current heat sinks are too small and inefficient to transfer the anticipated flow of heat. To overcome this inefficiency, a heat spreader may be employed. A heat spreader ideally has a high enough thermal conductivity to spread or disperse the heat flow from the relatively small footprint of the CPU to a larger area of the heat sink. This dispersal must occur rapidly to prevent the temperature of the CPU from rising beyond its critical point. The heat spreader must also be isotropic, i.e. have the ability to disperse the heat generally equally in all directions to insure constant dispersal. Specialized heat spreaders of synthetic diamonds in thin films currently exist for low-volume, special purpose applications, such as advanced high power solid-state lasers. However, synthetic diamonds films would be cost prohibitive for most applications in the mass-produced computer market. The isotropic nature of the cross-linked carbon nanotube arrays provide exceptional thermal conductivity which is ideal for heat spreader applications at an acceptable cost for most uses.

It should be understood that the foregoing description is only illustrative of the invention. Various alternatives and modifications may be devised by those skilled in the art without departing from the spirit and scope of the invention. Accordingly, the present invention is intended to embrace all such alternatives, modifications and variances which fall within the scope of the appended claims.

EXAMPLES

The experiments described herein were preformed with multi-wall and single wall nanotubes, which were purchased from Helix Material Solutions, Inc. (Richardson Tex., 75080). The methods used are described below.

Example 1

These nanotubes were functionalized using conventional catalyst-driven condensation polymerization, which resulted functional groups located on the nanotube surfaces. The organic functionalization was run as follows: purified CNTs were suspended in DMF [N,N-Dimethylformamide HCON $(CH_3)_2$] together with excess p-Anisaldehide (4-methoxybenzaldehyde, $CH_3OC_6H_4CHO$) and 3-methylhippuric acid (m-toluric acid, N-(3-methyl-benzoyl)glycine, $CH_3C_6H_4CONHCH_2CO_2H$), as shown in FIG. 3. The reaction produced, inter alia, functional groups on the nanotube surfaces which readily crosslink to one another.

The heterogeneous reaction mixture was heated at 130° C. for 70-120 hours.

After the reaction was stopped, the organic phase was separated from unreacted material by centrifugation, and washing five times with chloroform ($CHCl_3$). The organic phase materials were then vacuum dried.

The material obtained was a dark solid phase was easily soluble in $CHCl_3$ up to a few mg/mL without sonication. The functionalization was demonstrated by HRTEM photos (High Resolution Transmission Electron Microscopy), and FTIR (Fourier Transform Infrared Spectroscopy) where a distinct difference was shown in the absorption spectra between functionalized and non-functionalized nanotubes.

The functionalized nanotubes were made soluble in a polar organic solvent to form an aligned monolayer. The nanotube monolayer was formed using conventional Langmuir-Blodgett techniques. A set up for Langmuir-Blodget monolayer deposition of nanotubes with an alignment in electric fields was developed to control an orientation of CNTs. The deposition of the layers (or arrays) of nanotubes on solid-state substrate was done by Langmuir-Blodgett trough. The functionalized CNTs were self-assembled in a dense arrays at a surface pressure of ~9 mN/m.

A second round of cross-linking was then preformed on several monolayer films sandwiched one on another to cross-link the individual nanotubes between the monolayers. This condensation polymerization was done following the method used above. These stacks of nanotube monolayers were layered to rotate the alignment of each successive layer approximately 90° with respect to the layers above and below a particular layer. This rotation was done by mechanically by placing and stacking alternate layers according to their known alignments.

The stacked monolayers were inter-linked between the layers by argon ion bombardment using a system built in the lab. The tests were run in an antechamber of a complex surface analysis system, which was kept extremely clean. Samples to be analyzed were passed through the antechamber first, where a high vacuum was formed. The samples were then subjected to Argon (Ar+) Ion bombardment as a type of surface cleaning procedure to remove any possible contaminants. CNT monolayers were then placed in the ultra-clean antechamber, and a high vacuum was formed. The Ar+ ion beam was run at an acceleration voltage of 6 kV to interlink the CNT monolayers. The process was run at a partial pressure of Ar+ gas in the range of approximately 10^−5 Torr. The ion bombardment/processing was run for a time frame in the range of approximately 60 sec to approximately 600 seconds.

Cross-linking and interlinking of CNTs and monolayers was shown by Scanning Electron Microscopy (SEM) imaging. These images showed functionalized nanotubes assembled in dense monolayer arrays.

Example 2

As an alternative method, CNTs were also functionalized using PMMA (polymethyl-methacrylate) according to the following process:

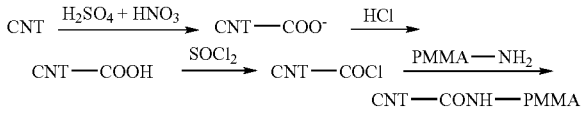

The reaction resulted in organic functionalization of the CNTs, which was verified as described above, and subjected to Ar+ ion bombardment as described above to form cross-linked CNT and interlinked CNT monolayer arrays.

Example 3

Additionally, early theoretical work suggested that substantial temperatures, 800° C. or more, were required to cross-link or assist in the cross-linking process. Initial experiments focused on multi-wall nanotubes ("CNTs") due to their relatively low cost and ready availability. To test this early theory, relatively low cost, vacuum compatible heater stage was assembled that could operate in a high-vacuum environment. This heater stage was assembled of parts obtained from McMaster-Carr New Brunswick, N.J. 08903-0440, (including the graphite rod, high-temperature ceramic cement, mica insulating sheets, nichrome heater wire, ceramic insulators, copper sheets, thermocouples, and the stainless steel hardware). Nanotubes were exposed to a high-vacuum environment during heating to approximately 800° C.

During the initial test runs, the heater stage exhibited out-gassing of volatiles which included sodium fluoride. This out-gassing is typically an undesirable process, and would be resolved by prolonged baking in high vacuum. However, in this case the heater stage with out-gassing of volatiles produced unexpected results. Sodium fluoride crystals coated the surface of the nanotubes. The sodium fluoride crystals were found to be a useful for functionalization by forming an anchor site between among nanotubes and between nanotubes and composite materials.

What is claimed is:

1. A dense array of carbon nanotube monolayers comprising:

at least one first monolayer, the at least one first monolayer includes functionalized carbon nanotubes that are aligned in a same direction relative to each other and is substantially free of non-carbon materials, at least one second monolayer, the at least one second monolayer includes functionalized carbon nanotubes that are aligned in a same direction relative to each other and is substantially free of non-carbon materials, wherein each of the at least one first and second monolayers is polymerized such that each of the functionalized carbon nanotubes of the first and second monolayer are cross-linked to adjacent carbon nanotubes within the respective monolayer, the at least one second monolayer being stacked upon the at least one first monolayer to form a three dimensional array of nanotubes such that the aligned carbon nanotubes of the at least one first monolayer are at a predetermined angle relative to the aligned carbon nanotubes of the at least one second monolayer and each successive monolayer being stacked at the predetermined angle relative to the aligned carbon nanotubes below the successive layer, wherein the aligned carbon nanotubes of the at least one first monolayer are inter-linked to the aligned carbon nanotubes of the at least one second monolayer at various points of contact to provide omni-directional strength.

2. The dense array of carbon nanotube monolayers of claim 1, wherein the predetermined angle is approximately 90 degrees.

3. The dense array of carbon nanotube monolayers of claim 1, wherein the aligned carbon nanotubes of the at least one first monolayer and the aligned carbon nanotubes of the at least one second monolayer are inter-linked by argon ion bombardment.

4. The dense array of carbon nanotube monolayers of claim 1, wherein the aligned carbon nanotubes of the at least one first monolayer and the aligned carbon nanotubes of the at least one second monolayer are inter-linked by polymerization.

5. The dense array of carbon nanotube monolayers of claim 1, wherein the aligned carbon nanotubes of the at least one first monolayer and the aligned carbon nanotubes of the at least one second monolayer are inter-linked by a condensation polymerization reaction.

6. The dense array of carbon nanotube monolayers of claim 1, wherein the functionalized carbon nanotubes are formed into the at least one first and second monolayers by a Langmiur-Blodgett technique.

7. The dense array of carbon nanotube monolayers of claim 1, wherein the functionalized carbon nanotubes are formed into the at least one first and second monolayers by a flow alignment technique.

8. The dense array of carbon nanotube monolayers of claim 1, wherein the inter-linked carbon nanotubes of the at least one first and second monolayers form a plurality of interstitial spaces.

9. The dense array of carbon nanotube monolayers of claim 8, wherein the plurality of interstitial spaces store hydrogen.

10. The dense array of carbon nanotube monolayers of claim 1, wherein carbon-carbon bonds are formed at the inter-linked various points of contact.

11. The dense array of carbon nanotube monolayers of claim 10, wherein the carbon-carbon bonds provide alternative pathways for mechanical and thermal forces between the carbon nanotubes of the at least one first and second monolayer to avoid defects in the carbon nanotubes.

12. A heat spreader for use in an electronic device comprising the dense array of carbon nanotube monolayers of claim 11.

13. The dense array of carbon nanotube monolayers of claim 1, wherein at the inter-linked various points of contact the carbon nanotubes interpenetrate each other.

* * * * *